US009738945B2

(12) United States Patent
Yoshida et al.

(10) Patent No.: US 9,738,945 B2
(45) Date of Patent: Aug. 22, 2017

(54) PROCESS FOR PRODUCING FORGED PRODUCT

(75) Inventors: Jun Yoshida, Ichikawa (JP); Daisuke Kaneko, Yokohama (JP); Noriyuki Iwata, Ayase (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 356 days.

(21) Appl. No.: 14/374,409

(22) PCT Filed: Jan. 31, 2012

(86) PCT No.: PCT/JP2012/052079

§ 371 (c)(1),
(2), (4) Date: Jul. 24, 2014

(87) PCT Pub. No.: WO2013/114553

PCT Pub. Date: Aug. 8, 2013

(65) Prior Publication Data

US 2014/0373351 A1 Dec. 25, 2014

(51) Int. Cl.
*C21D 1/02* (2006.01)
*C21D 7/13* (2006.01)
(Continued)

(52) U.S. Cl.
CPC ..... *C21D 7/13* (2013.01); *B21K 1/08* (2013.01); *C21D 1/02* (2013.01); *C21D 9/30* (2013.01); *C22C 38/00* (2013.01); *C22C 38/02* (2013.01); *C22C 38/04* (2013.01); *C22C 38/38* (2013.01); *C22C 38/42* (2013.01); *C22C 38/60* (2013.01); *C21D 2211/005* (2013.01); *C21D 2211/009* (2013.01); *Y10T 29/49286* (2015.01)

(58) Field of Classification Search
CPC ... C21D 7/13; C21D 1/02; C21D 9/30; C21D 2211/009; C21D 2211/005; B21K 1/08; C22C 38/04; C22C 38/42; C22C 38/02; C22C 38/60; C22C 38/38; C22C 38/00; Y10T 29/49286
See application file for complete search history.

(56) References Cited

U.S. PATENT DOCUMENTS

2002/0139451 A1* 10/2002 Ishida ..... C23C 8/26 148/333

FOREIGN PATENT DOCUMENTS

JP 07-062444 A 3/1995
JP 2003-055714 A 2/2003
(Continued)

OTHER PUBLICATIONS

JP2003055714A translation.*

*Primary Examiner* — Sarang Afzali
*Assistant Examiner* — Ruth G Hidalgo-Hernandez
(74) *Attorney, Agent, or Firm* — Young Basile Hanlon & MacFarlane, P.C.

(57) ABSTRACT

A forging process is conducted in a temperature range of 350-600° C. on at least a portion that is required to have a fatigue strength in an intermediate forged product having a ferrite and pearlite texture obtained by conducting a hot forging on a steel in which N is not greater than an amount at which N is unavoidably dissolved as a solid, thereby improving strength of the portion that is required to have a fatigue strength. With this, there is provided a forged product having a good strength and a low price.

10 Claims, 11 Drawing Sheets

(51) Int. Cl.

| | |
|---|---|
| ***C22C 38/00*** | (2006.01) |
| ***C22C 38/38*** | (2006.01) |
| ***C22C 38/60*** | (2006.01) |
| ***C22C 38/02*** | (2006.01) |
| ***C22C 38/04*** | (2006.01) |
| ***C22C 38/42*** | (2006.01) |
| ***B21K 1/08*** | (2006.01) |
| ***C21D 9/30*** | (2006.01) |

(56) References Cited

FOREIGN PATENT DOCUMENTS

| | | | |
|---|---|---|---|
| JP | 2003-055715 | A | 2/2003 |
| JP | 2006-052432 | A | 2/2006 |
| JP | 2009-263684 | A | 11/2009 |
| JP | 2012-020298 | A | 2/2012 |

* cited by examiner

PROCESS FOR PRODUCING FORGED PRODUCT

TECHNICAL FIELD

The present invention relates to a process for producing a forged product.

BACKGROUND

The element V is added to materials in order to improve strength (yield strength and fatigue strength) of forged products or to omit heat treatments. It has, however, problems in the price fluctuation by resource depletion of V and its addition cost.

Therefore, a good strength is assured by conducting a forging process against a portion required to have a high-level strength, in a temperature range of from not higher than $Ar_1$ transformation point to 200° C. during the cooling process after a hot forging (for example, see Japanese Patent Application Publication 2003-055714).

In case that the forging process is conducted in the blue shortness region, however, it is necessary to have a heat treatment for the embrittlement recovery. Therefore, it is difficult to reduce the production cost. On the other hand, in the case of applying a temperature range of not lower than 600° C., it becomes a heating close to $Ar_1$ transformation point. Therefore, the previously obtained ferrite and pearlite texture starts growing, and pearlite grains start enlarging. Furthermore, the ferrite precipitation occurs in the pearlite grains from the strain after the process as a point of the origin. Therefore, it is difficult to obtain the target strength.

SUMMARY

The present invention was made to solve the task accompanied with the above-mentioned prior art, and its object is to provide a process for producing a forged product having a good strength and a low price.

The present invention for achieving the above object provides a process for producing a forged product with an improved strength by conducting a forging process on at least a portion that is required to have a fatigue strength of an intermediate forged product having a ferrite and pearlite texture obtained by conducting a hot forging on a steel in which N is not greater than the amount at which N is unavoidably dissolved as a solid. The forging process is conducted in a temperature range of 350-600° C.

According to the present invention, it is a forging process at 600° C. or lower. Therefore, even if it generates heat by the forging process, it does not reach the temperature at which austenite is precipitated. Furthermore, the enlargement of the pearlite grains is suppressed. Therefore, it is possible to obtain the target strength (yield strength and fatigue strength) by the forging process. Furthermore, since it is a forging process at a temperature of 350° C. or higher, it is a temperature higher than the blue shortness region (the blue shortness occurring temperature range: lower than about 200-350° C.). Therefore, a heat treatment for the embrittlement recovery is not necessary. With this, it is possible to reduce the production cost. Furthermore, it is steel in which N is not greater than the amount at which N is unavoidably dissolved as a solid. Therefore, hydrogen embrittlement of the forged product is suppressed. With this, it becomes possible to obtain the target strength. That is, it is possible to provide a process for producing a forged product having a good strength and a low price.

DETAILED DESCRIPTION OF THE EMBODIMENTS

In a process for producing a forged product according to an embodiment of the present invention, a forging process is conducted in a temperature range of 350-600° C. against at least a portion required to have a fatigue strength in an intermediate forged product having a ferrite and pearlite texture obtained by subjecting a steel to a hot forging. It does not use a steel containing N as a chemical component as in conventional production processes, but uses a steel in which N is not greater than the amount at which N is unavoidably dissolved as a solid. Therefore, it was made based on a technological idea that is totally different from conventional ones.

In the technological field of conventional forged products, it has been considered that an N-containing steel material tends to undergo an age hardening to obtain a high-strength forged product. However, there was a risk that hydrogen was adsorbed to N after this age hardening to cause hydrogen embrittlement. A forged product having many portions with hydrogen embrittlement tends to be broken by the occurrence of cracks.

Furthermore, for example, in the case of adding Al as a deoxidizer, the Al combines with N to precipitate AlN. Therefore, it has been taken an approach to make the amount of N dissolved as a solid in a steel material exceed the amount at which it is unavoidably dissolved as a solid, by using an additive such as lime nitrogen, NMn, etc., or by setting long the RH degassing time by an N reflux gas for ensuring yield. This has caused not only a further hydrogen embrittlement, but also the increase of the production cost.

In an embodiment of the present invention, a steel containing N that is not greater than the amount at which N is unavoidably dissolved as a solid is one that is different from conventional steel materials with increased amounts of N dissolved as a solid therein by an intentional addition and refers to a steel material at a level containing N that is unavoidable and can be dissolved as a solid with no addition. For example, it is possible to cite a steel material with no detection of N by an activated gas dissolved, thermal conductivity method (TDC method) according to JIS.

In a process for producing a forged product according to an embodiment of the present invention, it is possible to suitably apply a production process technology known in the field of forged products, as long as a forging process is conducted in a temperature range of 350-600° C. against at least a portion required to have a fatigue strength in an intermediate forged product as mentioned above, and as long as there is used a steel containing N that is not greater than the amount at which N is unavoidably dissolved as a solid.

Figure 1:
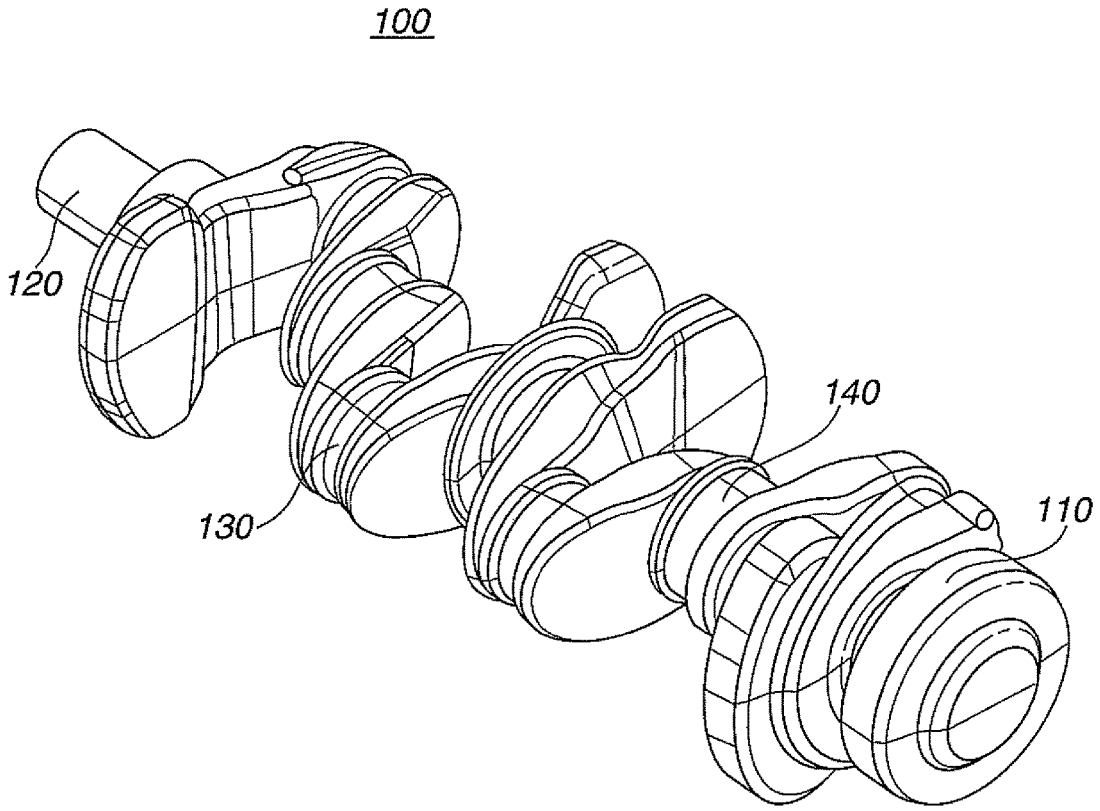
FIG. 1 is a perspective view for explaining a forged product according to an embodiment of the present invention.

FIG. 1 is a perspective view for explaining a forged product according to an embodiment of the present invention.

The forged product according to an embodiment of the present invention is crankshaft 100, which is a large-size component having a complicated shape. Crankshaft 100 has flange portion 110, gear shaft portion 120, crank pin 130, and journal 140. For example, it is used as a component for internal combustion engines, such as automotive engines, for converting a reciprocating motion of pistons in reciprocating engines to a rotational motion.

Flange portion 110 is at the rear end of crankshaft 100. For example, a flywheel or a torque converter is attached thereto. Gear shaft portion 120 is at the front end of crankshaft 100. For example, a crank gear or a crank pulley is attached thereto. Crank pin 130 has a circular section, is disposed at a position that is eccentric from the axis of journal 140, and is to be slidably connected to the connecting rod of the piston. Journals 140 have a circular section and are rotatably supported, while crank portions, of which number corresponds to the number of engine cylinders, are arranged thereto.

Figure 2:
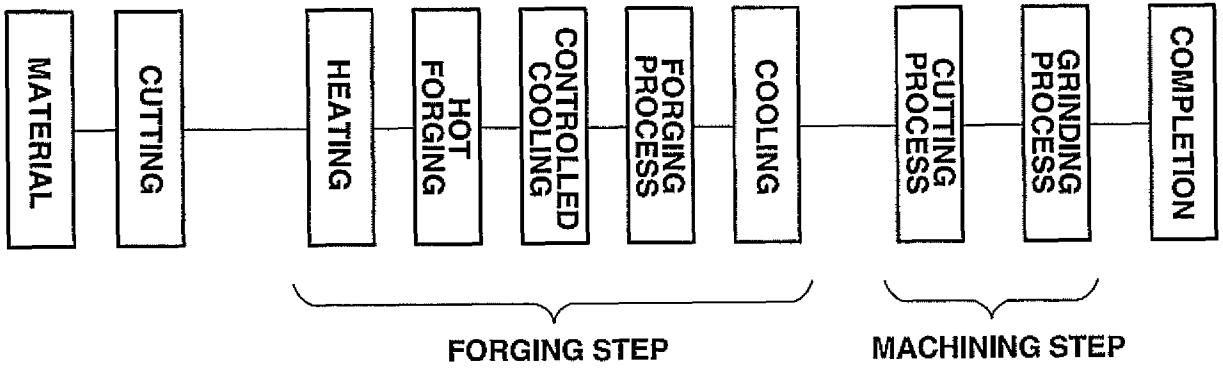
FIG. 2 is a flowchart for explaining a process for producing a forged product according to an embodiment of the present invention.
Figure 3:
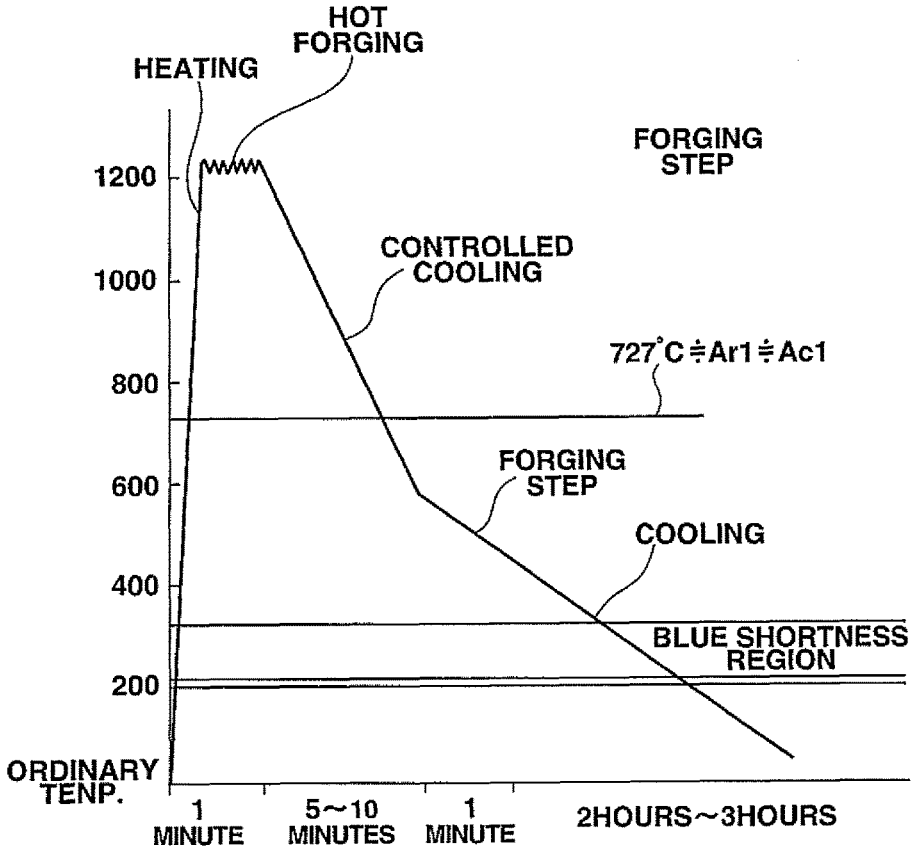
FIG. 3 is a time chart for explaining the forging step shown in FIG. 2.
Figure 4:
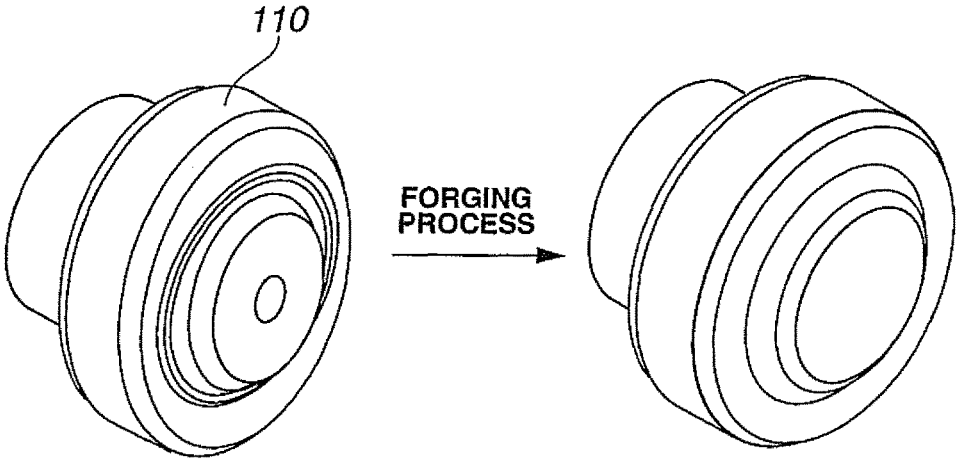
FIG. 4 is a perspective view for explaining a partial process of a flange portion, to which the forging process shown in FIG. 3 is applied.
Figure 5:
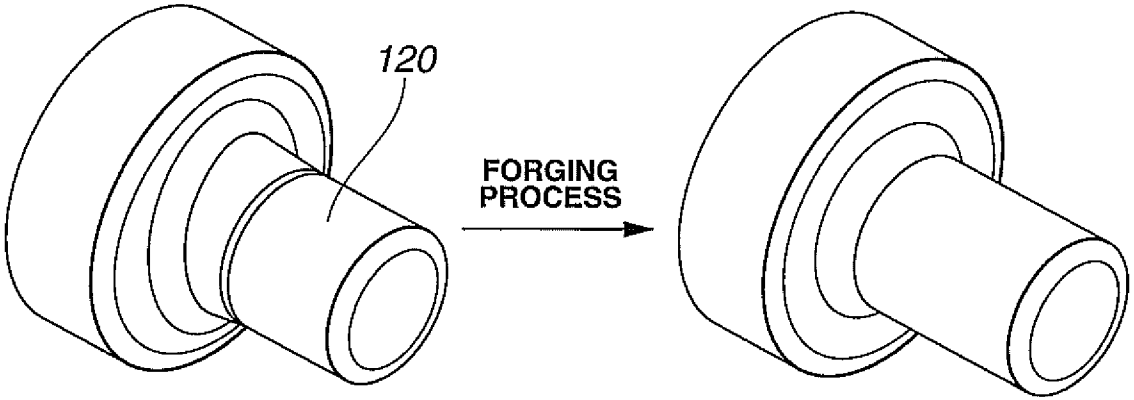
FIG. 5 is a perspective view for explaining a partial process of a gear shaft portion, to which the forging process shown in FIG. 3 is applied.

FIG. 2 is a flowchart for explaining a process for producing a forged product according to an embodiment of the present invention. FIG. 3 is a time chart for explaining the forging process shown in FIG. 2. FIGS. 4 and 5 are perspective views for explaining partial processes of a flange portion and a gear shaft portion, to which the forging process shown in FIG. 3 is applied.

The process for producing a forged product according to an embodiment of the present invention generally has a cutting step, a forging step, and a machining step.

In the cutting step, for example, a crankshaft material is obtained by cutting a carbon steel material for mechanical structures.

In the forging step, a hot forging and a forging process are conducted on the crankshaft material to improve strength (yield strength and fatigue strength) of a portion (the target portion) required to have a fatigue strength. The target portion is, for example, flange portion 110 (see FIG. 4) and gear shaft portion 120 (see FIG. 5).

In the machining step, a cutting step and a grinding step are conducted on an ordinary temperature, intermediate forged product, which has undergone the forging step, to obtain crankshaft 100 as a finished product. In the cutting process, for example, a protruding burr and the like are removed. In the grinding process, for example, outer peripheral surfaces of crank pins 130 and journals 140 with circular sections are treated. Then, the forging step is described in detail with reference to FIG. 2 and FIG. 3.

In the forging step, at first, the crankshaft material that is sent from the cutting step is heated to raise the temperature to about 1200° C. After that, a hot forging is conducted, for example, for one minute not to be lower than the transformation point. Then, it is subjected to a controlled cooling by a predetermined cooling rate to obtain an intermediate forged product having a ferrite and pearlite texture.

As it reaches a temperature region of 350-600° C. by a lapse of 5-10 minutes, the forging process is conducted on the target portion in the intermediate forged product. The forging process is conducted, for example, for one minute, and thereby a relative strain of 0.1 mm/mm or greater is provided.

Since the forging process is conducted at 600° C. or lower, even if the target portion of the intermediate forged product generates heat by the forging process, it does not reach 727° C., which generally corresponds to $Ac_1$ transformation point and $Ar_1$ transformation point. That is, the intermediate forged product does not reach the temperature at which austenite is precipitated. Furthermore, since enlargement of pearlite grains is suppressed, it is possible to obtain the target strength (yield strength and fatigue strength) by the forging process.

On the other hand, since the forging process is conducted at a temperature of 350° C. or higher, it is a temperature higher than the blue shortness region. Therefore, it becomes unnecessary to have a heat treatment (for example, tempering and sub-zero treatment) for the embrittlement recovery. With this, it is possible to reduce the production cost.

Therefore, in case that the target portion of the intermediate forged product is flange portion 110 of crankshaft 100, the flange strength is improved. Therefore, it is possible to make crankshaft 100 have a lighter weight by making flange portion 110 smaller. Furthermore, it is possible to make mass of the engine smaller by making flywheel fastening bolts have a smaller diameter. Furthermore, in case that the target portion of the intermediate forged product is gear shaft portion 120 of crankshaft 100, strength of the gear shaft is improved. Therefore, it is possible to make the crankshaft have a lighter weight by making gear shaft portion 120 have a smaller diameter.

Furthermore, the target portion of the intermediate forged product is made to reach the above-mentioned temperature range by using excess heat of the hot forging. Therefore, it is possible to reduce (save) heat energy.

Then, the intermediate forged product subjected to the forging process is cooled until ordinary temperature and sent into the machining step. The cooling time is, for example, two to three hours.

The crankshaft has a complicated shape. Therefore, it is preferable to conduct a hot forging at 1000° C. to 1250° C. for the purpose of lowering the material deformability and the deformation resistance upon shaping and to immediately conduct a controlled cooling at a cooling rate of 5° C./second or lower to obtain a ferrite and pearlite mixed texture. This is because it becomes a bainite texture at 5° C./second or higher to markedly damage machinability.

Since it is necessary to improve a partial strength, it is necessary to increase the cooling rate of the target portion upon cooling. In a range of less than 3 mm from the surface, it is possible to improve the strength by making a martensite by quenching or the like, but it damages machinability. Furthermore, in case that the necessary portion reaches an interior of 3 mm or greater from the surface, it is difficult to give a uniform cooling rate from the surface to the interior.

The temperature of the forging process conducted on the intermediate forged product is relatively low. Therefore, the material thermal expansion coefficient is small, and it is possible to improve the dimension precision. Furthermore, the material deformation resistance becomes smaller in the forging process than in the cold. Therefore, it becomes possible to reduce the facility size or increase the amount of deformation (for example, a high deformation capable of providing strain until the core portion).

Next, experiment results and CAE (Computer Aided Engineering) analysis results by a test piece in relation to the flange portion are explained.

Figure 6:
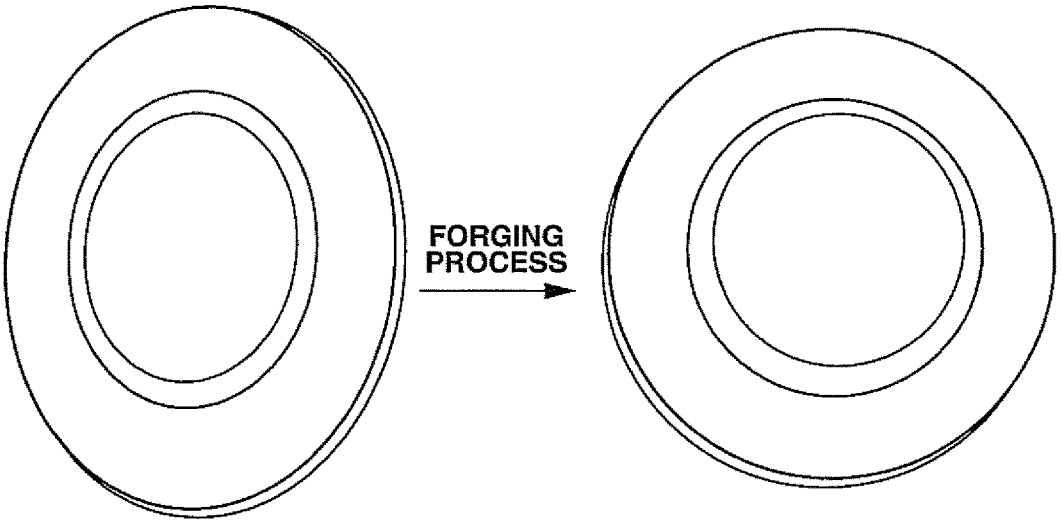
FIG. 6 is a plan view for explaining a test piece in relation to the flange portion, to which the forging process in relation to FIG. 5 is applied.
Figure 7:
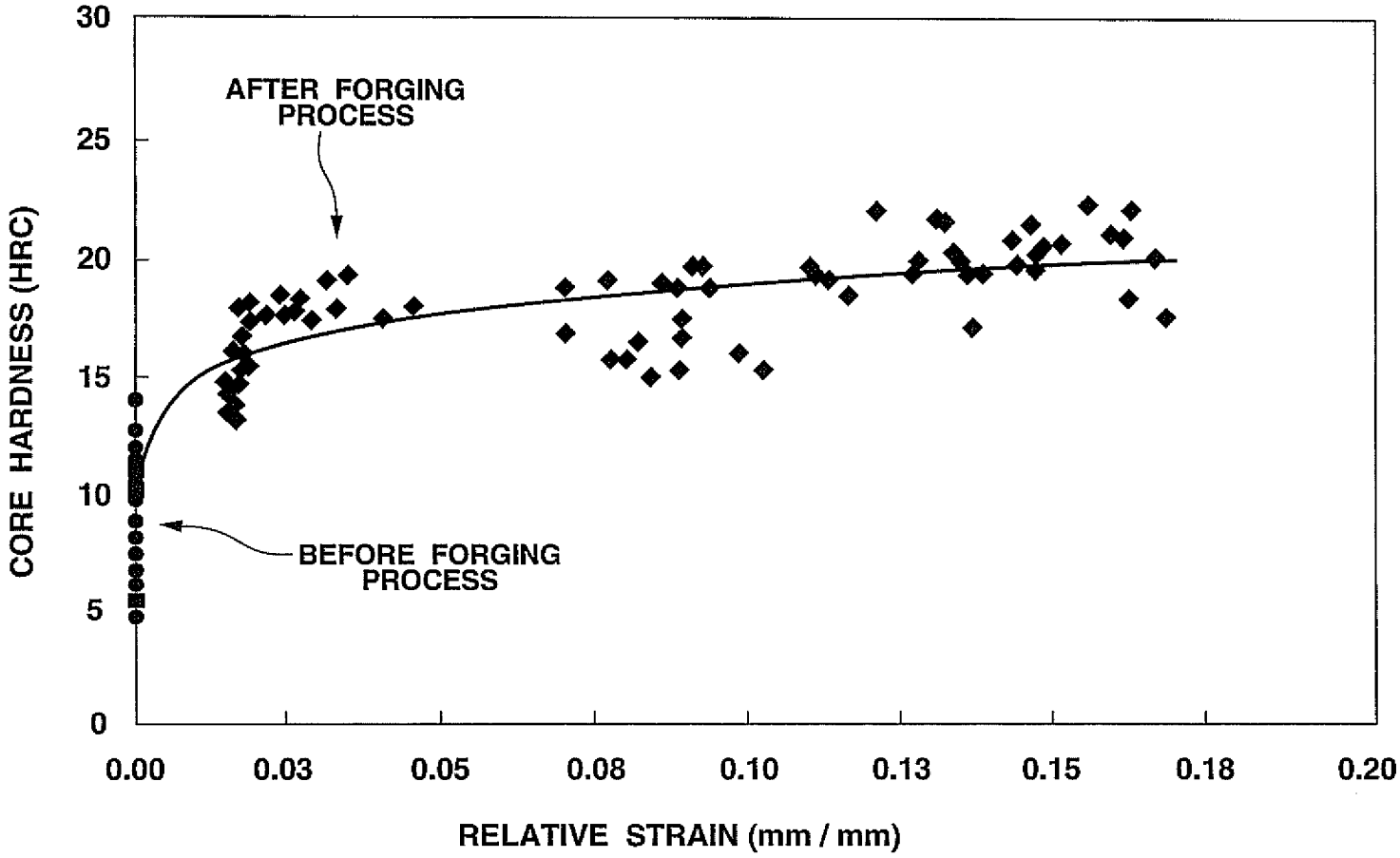
FIG. 7 is a graph showing a correlation between the core hardness and the relative strain before and after the forging process in relation to FIG. 5.
Figure 8:
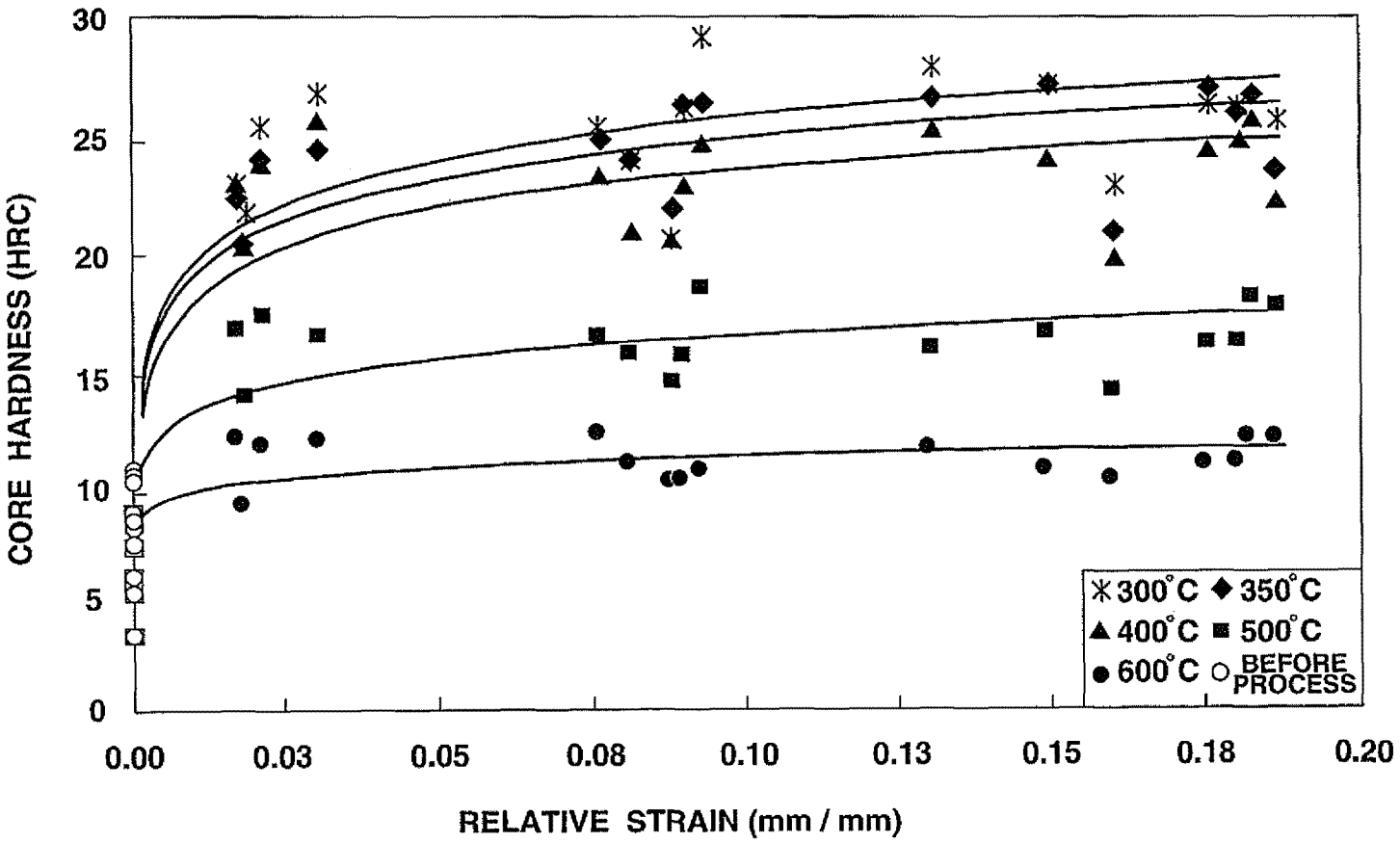
FIG. 8 is a graph showing the effect of temperature in the correlation between the core hardness and the relative strain by the forging process in relation to FIG. 5.

FIG. 6 is a plan view for explaining a test piece in relation to the flange portion, to which the forging process is applied. FIG. 7 is a graph showing a correlation between the core hardness and the relative strain before and after the forging process in relation to FIG. 5. FIG. 8 is a graph showing the effect of temperature in the correlation between the core hardness and the relative strain by the forging process in relation to FIG. 5. The strength is evaluated by hardness (HRC: Rockwell hardness).

Assuming that the target portion of the intermediate forged product is flange portion 110 of crankshaft 100, we have made a test piece of a cutaway model shown in FIG. 6. Material of the test piece is S40C in which N is not greater than the amount at which N is unavoidably dissolved as a solid. The amount of C is the lower limit at which crankshaft strength is satisfied, and alloy components used for improving the material strength have been removed. The forging process is conducted in a temperature range of 300 to 600° C., and it is shaped from an oval shape to a circular shape.

It was necessary to introduce a relative strain of a certain amount or higher (for example, 0.05 mm/mm or higher, preferably 0.1 mm/mm or higher) in order to leave the effect of the forging process until an interior and a core portion, which are deeper than a portion to be removed by the cutting process and the grinding process in the machining step as the subsequent step. Therefore, it is essential to design a shape capable of introducing the above-mentioned relative strain.

As is understood from FIG. 7 showing the results of the correlation between the core hardness and the relative strain before and after the forging process under each temperature condition, it shows a tendency that the strain-introduced portion is improved in core hardness and that, as the introduced strain becomes larger (as the relative strain becomes larger), the core hardness also increases.

As is understood from FIG. 8 showing the effect of temperature in the correlation between the core hardness and the relative strain by the forging process, in a temperature range that is $Ac_1$ temperature or lower (600° C. or lower) and exceeds the blue shortness region (lower than about 200-350° C.), it shows a tendency that the core hardness of the strain-introduced portion improves and that, as the introduced strain becomes larger (as the relative strain becomes larger), the core hardness also increases. That is, the forging process is conducted in a temperature range of 350-600° C. With this, a transformation-completed texture is provided with strain (dislocation), resulting in hardening, and it is aged by potential heat upon the forging process, thereby improving strength without embrittlement. From this, we can read that the potential heat is involved from the change of the hardness level accompanied with the forging process temperature.

The intermediate forged product subjected to cooling until ordinary temperature with no forging process after the hot forging was then heated until a temperature range of 350-600° C. and subjected to the forging process. With this, a similar effect (phenomenon) was obtained. However, in a forging process at 600° C. or higher, no change from the value prior to the process occurred by the pearlite grain growth and the ferrite precipitation in the pearlite grains.

Next, the experiment results and CAE (Computer Aided Engineering) analysis results by the test piece are explained.

Figure 9:
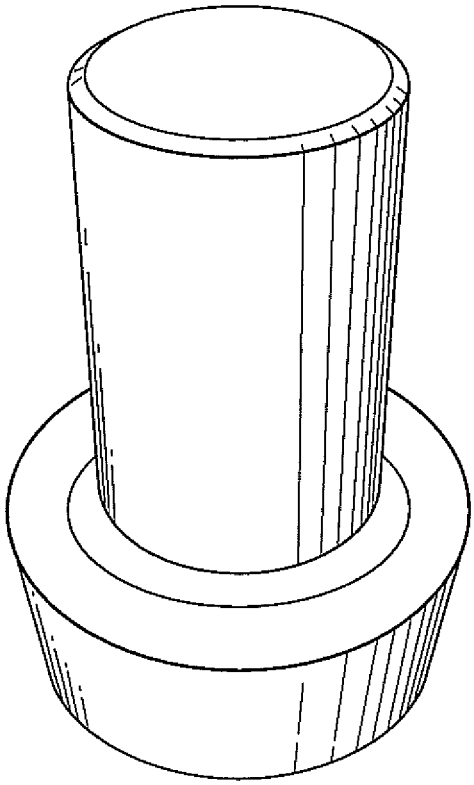
FIG. 9 is a perspective view for explaining a test piece in relation to the gear shaft, to which the forging process is applied.
Figure 10:
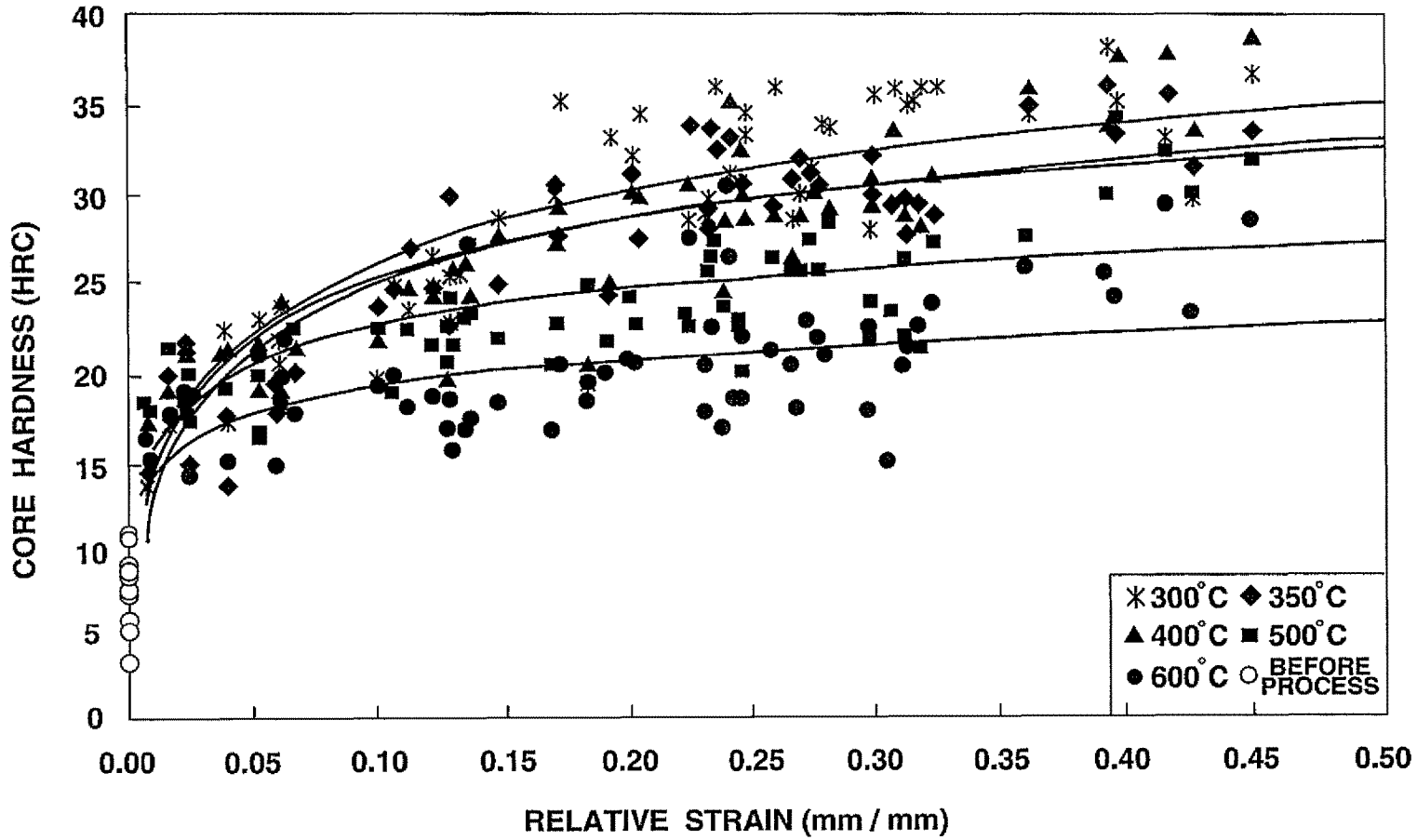
FIG. 10 is a graph showing the effect of temperature in the correlation between the core hardness and the relative strain by the forging process in relation to FIG. 9.

FIG. 9 is a perspective view for explaining a test piece in relation to the gear shaft portion, to which the forging process is applied. FIG. 10 is a graph showing the effect of temperature in the correlation between the core hardness and the relative strain by the forging process in relation to FIG. 9.

Assuming that the target portion of the intermediate forged product is gear shaft portion 120 of crankshaft 100, we have made a test piece of a cutaway model shown in FIG. 9. The material of the test piece is the same as that of the test piece in relation to flange portion 110.

As is understood from FIG. 10 showing the effect of temperature in the correlation between the core hardness and the relative strain by the forging process, the increase of the core hardness is found as the amount of strain introduced becomes larger. As compared with the case of FIG. 8, there occurs a difference (average: 5 HRC) of the core hardness in the forging process at 600° C. This is because untransformed (metastable austenite) after the forging becomes smaller in number to cause no occurrence of the pearlite grain growth and the ferrite precipitation due to conducting a sufficient cooling on the test piece in relation to the gear shaft portion, as compared with the case of the test piece in relation to the flange portion.

Figure 11:
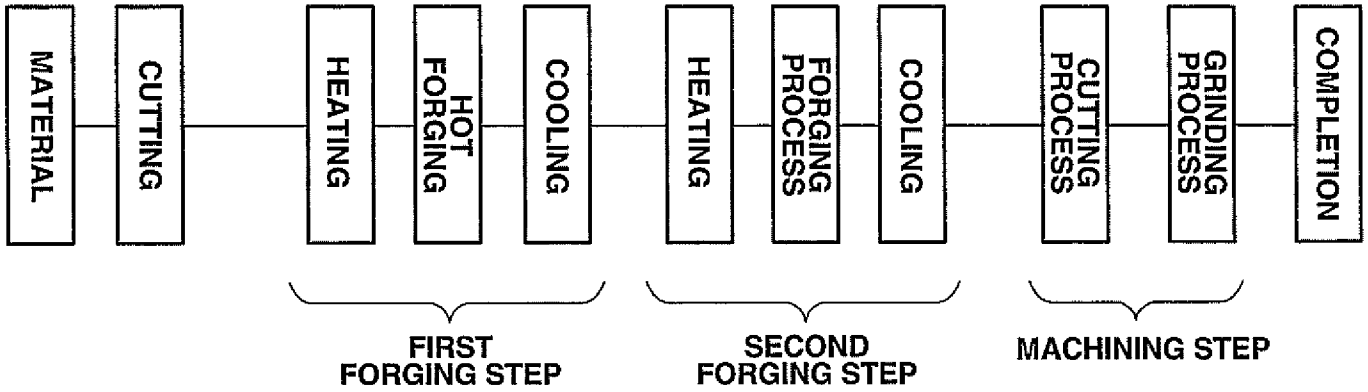
FIG. 11 is a flowchart for explaining a modified example according to an embodiment of the present invention.

FIG. 11 is a flowchart for explaining a modified example according to an embodiment of the present invention.

The present modified example independently has the first forging step in relation to the hot forging and the second forging step in relation to the forging process. After the hot forging, temperature of the intermediate forged product is decreased until ordinary temperature. Then, temperature of a portion required to have a fatigue strength in the intermediate forged product is increased (heating) until a temperature range of 350-600° C., followed by a forging process of a relative strain of 0.1 mm/mm or higher.

In this case, it is not necessary to consecutively conduct the forging process after the hot forging. Therefore, liberty in the steps improves. Furthermore, the forging process is a partial treatment against a portion (the target portion) required to have a fatigue strength in the intermediate forged product. Therefore, it is possible to reduce the necessary energy, as compared with a normal tempering treatment required to have a maintenance at the same temperature by heating the entirety. Furthermore, the strength decrease (annealing effect) of the other portions except the target portion is suppressed.

As mentioned above, in the present embodiment, it is a forging process of 600° C. or lower. Therefore, even if it generates heat by the forging process, it does not reach the temperature at which austenite is precipitated. Furthermore, since enlargement of pearlite grains is suppressed, it is possible to obtain the target strength (yield strength and fatigue strength) by the forging process. Furthermore, since it is a forging process at a temperature of 350° C. or higher, the temperature is higher than the blue shortness region, thereby making unnecessary a heat treatment for the embrittlement recovery. With this, it is possible to reduce the production cost. That is, it is possible to provide a process for producing a forged product with a good strength and a low price.

In case that the temperature of a portion required to have a fatigue strength is made to reach the above temperature range by using excess heat when conducting the forging process, it is possible to reduce (save) heat energy for making the temperature of the portion required to have a fatigue strength reach a temperature range of 350-600° C.

In the case of decreasing the temperature of the intermediate forged product until ordinary temperature after the hot forging, and then increasing the temperature of a portion required to have a fatigue strength in the intermediate forged product to a temperature range of 350-600° C. to conduct a forging process, it is not necessary to consecutively conduct the forging process after the hot forging. Therefore, liberty in the steps improves. Furthermore, the forging process is a partial treatment against a portion (the target portion) required to have a fatigue strength in the intermediate forged product. Therefore, it is possible to reduce the necessary energy, as compared with a normal tempering treatment required to have a maintenance at the same temperature by heating the entirety. Furthermore, the strength decrease (annealing effect) of the other portions except the target portion is suppressed.

In case that a portion required to have a fatigue strength in the intermediate forged product is a flange portion of the crankshaft, the flange strength improves. Therefore, it is possible to make the crankshaft have a lighter weight by making the flange portion smaller. Furthermore, it is possible to make mass of the engine smaller by making flywheel fastening bolts have a smaller diameter.

In case that a portion required to have a fatigue strength in the intermediate forged product is the gear shaft portion of the crankshaft, the gear shaft strength improves. Therefore, it is possible to make the crankshaft have a lighter weight by making the gear shaft have a smaller diameter.

A portion required to have a fatigue strength in the intermediate forged product is not limited to the flange portion and the gear shaft portion of the crankshaft. For example, in the case of applying a pin portion of the crankshaft as a portion required to have a fatigue strength in the intermediate forged product, the pin strength of the crankshaft improves. Therefore, it is possible to make the crankshaft have a lighter weight by making the pin have a smaller diameter. Furthermore, it is possible to make mass of the engine smaller and reduce the sliding friction by making smaller the connecting rods to be attached. For example, in the case of applying the journal portion of the crankshaft as a portion required to have a fatigue strength in the intermediate forged product, the journal strength of the crankshaft improves. Therefore, it is possible to make the crankshaft have a lighter weight and reduce the sliding friction.

In order to achieve good physical properties, such as improvement of strength, in a wide temperature range, it is possible to set the content of each chemical component of the material steel of the forged product in various ranges. As its one example, it is preferably one containing, by mass %, 0.20-0.60% C, 0.05-1.50% Si, 0.30-2.0% Mn, up to 1.5% (0% is not included) Cr, and 0.001-0.06% Al. Since it does not contain high-price V and the like, it is possible to reduce the material cost.

That is, C is an important component as an element for improving strength. If it is less than 0.20%, there is a risk of strength insufficiency. If it exceeds 0.60%, toughness and ductility become low, and tensile strength becomes too large. With this, there is a risk of causing lowering of machinability. Therefore, the content of C is preferably 0.20-0.60%.

Si acts as a deoxidizing element. It is effective for improving yield strength and fatigue strength by dissolution as a solid in the ferrite matrix. If it is less than 0.05%, the effect is not noticeable. If it exceeds 1.50%, there is a risk of lowering machinability or increasing decarburization after the hot forging. Therefore, the content of Si is preferably 0.05-1.50%.

Mn is an element for increasing strength and toughness after the hot forging. If it is less than 0.30%, the effect is noticeable. If it exceeds 2.00%, there is a rink of lowering of machinability by the formation of bainite. Therefore, the content of Mn is preferably 0.30-2.0%.

Cr acts as an element for improving strength. It shows an action to improve ductility and yield strength and to increase fatigue strength by making the pearlite lamellar spacing smaller. If it exceeds 1.5%, it has a tendency to lower machinability by the formation of bainite. Therefore, the content of Cr is preferably not higher than 1.5%.

Al is one acting as a deoxidizing element. In case that it combines with N in an amount at which N is unavoidably dissolved as a solid, AlN is formed to contribute to suppressing the enlargement of austenite grains upon the hot forging and to also improving the yield strength ratio by accelerating the texture refinement. If it is less than 0.001, the effect is not noticeable. If it exceeds 0.06%, it causes lowering of machinability by the increase of $Al_2O_3$ as an oxide-series inclusion. Therefore, the content of Al is preferably 0.001-0.06%.

As another element, Ni is an element useful as a toughness improving element. It is contained to be 0.02% or greater. Preferably, it is 0.2% or greater. Since an excessive amount of Ni increases the cost, it is set to be 3.5% or less, preferably 3.0% or less.

Cu is an element that is unavoidably contained as an impurity or may be added as a toughness improving element (in the case of containing Cu as a toughness improving element, the amount of Cu is set at preferably 0.05% or greater, more preferably 0.1% or greater). If the amount of Cu exceeds 1.0%, it becomes a cause of the cost increase, and there is a risk of generating heat cracking. Therefore, the amount of Cu is 1.0% or lower, preferably 0.5% or lower.

Furthermore, in order to improve machinability, it is preferable that the material steel of the forged product contains as another element at least one selected from the group consisting of 0.10% or lower of S and 0.30% or lower (0% is not included) of Bi. Due to not containing Pb, it is possible to reduce the environmental burden. Besides N, it is possible to cite P or the like as one example of unavoidable impurities. P is preferably 0.03% or lower, more preferably 0.02% or lower.

Next, we explain experiment results and CAE (Computer Aided Engineering) analysis results by test pieces (A to E) in which chemical components are defined by mass % to be 0.20-0.60% of C, 0.05-1.50% of Si, 0.30-2.0% of Mn, 0.03% or lower (0% is not included) of P, 0.10% or lower (0% is not included) of S, 1.0% or lower (0% is not included) of Cu, 3.5% or lower (0% is not included) of Ni, and 1.5% or lower (0% is not included) of Cr.

Figure 12:
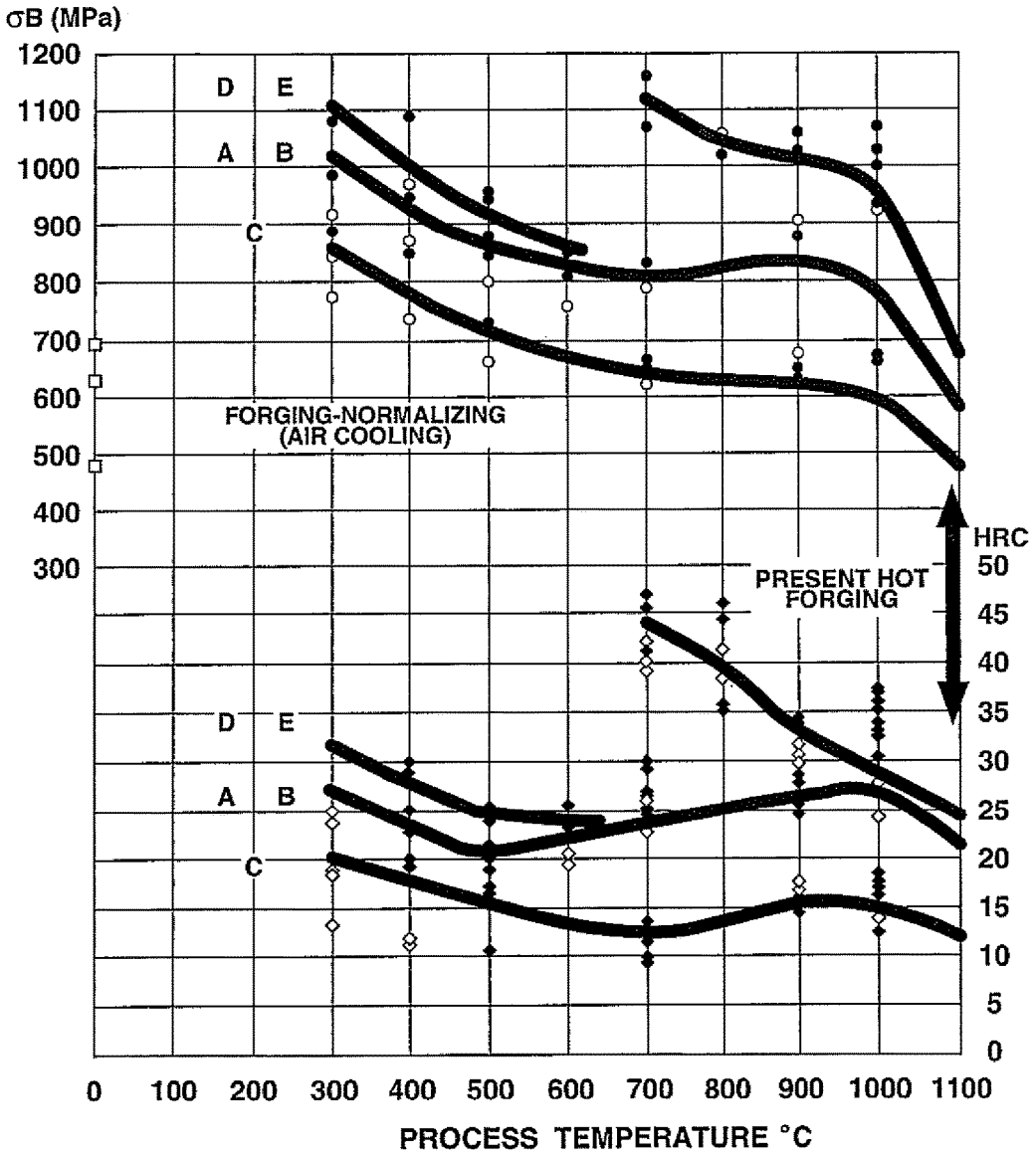
FIG. 12 is a graph showing the effect of the chemical component content in the correlation between strength (core hardness and tensile strength) by the forging process in relation to FIG. 5 and the forging process temperature.

FIG. 12 is a graph showing the effect of the chemical component content in the correlation between strength (core hardness and tensile strength) by the forging process in relation to FIG. 5 and the forging process temperature. Strength is evaluated by hardness (HRC: Rockwell hardness).

Assuming that the target portion of the intermediate forged product is gear shaft portion 120 of crankshaft 100, we have made test pieces of a cutaway model shown in FIG. 5. The materials of the test pieces are S40C, S25C and S45C, in which N is not greater than the amount at which N is unavoidably dissolved as a solid, and which are defined as shown in the following Table 1. The forging process is the same as that of each of the above-mentioned experiments.

The P content, the Cu content and the Ni content in the test pieces A-E, the Cr content in the test pieces B and C, and the S content in the test pieces A, C and D of the following Table 1 are derived from the raw materials such as scrap, etc. They have not intentionally been added, and any of them corresponds to an unavoidable impurity. N has not been added to each of the above-mentioned test pieces A-E. As to the N content, the results obtained by an analysis by an activated gas dissolved, thermal conductivity method (TDC method) according to JIS were each confirmed to be less than 0.0030%.

TABLE 1

| | Chemical Components (mass %) | | | | | | | |
|---|---|---|---|---|---|---|---|---|
| | C | Si | Mn | P | S | Cu | Ni | Cr |
| Test Piece A (S40C) | 0.41 | 0.23 | 0.78 | 0.018 | 0.024 | 0.13 | 0.05 | 0.24 |
| Test Piece B (S40C) | 0.41 | 0.2 | 0.73 | 0.013 | 0.018 | 0.02 | 0.03 | 0.15 |
| Test Piece C (S25C) | 0.26 | 0.18 | 0.4 | 0.014 | 0.018 | 0.02 | 0.02 | 0.07 |
| Test Piece D (S45C) | 0.45 | 0.25 | 1.04 | 0.021 | 0.058 | 0.01 | 0.02 | 0.32 |
| Test Piece E (S45C) | 0.48 | 0.32 | 0.78 | 0.014 | 0.022 | 0.02 | 0.02 | 0.17 |

As is understood from FIG. 12, in the case of conducting the forging process in a temperature range of 350-600° C. in test pieces A-E, it is possible to obtain the target strength (yield strength and fatigue strength). Particularly, in the case of using test pieces A and B, we can read that good results have been obtained.

The present invention is not limited to the above-mentioned embodiments, but can variously be modified in the scope of the claims. For example, the forged product is not limited to the crankshaft, but can also be applied to a connecting rod for internal combustion engines. As to the material steel of the forged product, it is also possible to apply another carbon steel for mechanical structures, except S40C.

The invention claimed is:

1. A process for producing a forged product comprising:

conducting a forging process in a temperature range of 350-600° C. on at least a portion required to have a fatigue strength of an intermediate forged product, the intermediate forged product having a ferrite and pearlite texture obtained by conducting a hot forging on a steel in which nitrogen is less than 0.0030 mass %, thereby improving strength of the portion that is required to have a fatigue strength, wherein the steel contains, by mass %, chemical components of 0.20-0.60% C, 0.05-1.50% Si, 0.30-2.0% Mn, 0.03% or lower and greater than 0% P, 0.10% or lower and greater than 0% S, 1.0% or lower and greater than 0% Cu, 3.5% or lower and greater than 0% Ni, and 1.5% or lower and greater than 0% Cr, Fe as a remainder, and unavoidable impurities.

2. The process for producing a forged product as claimed in claim 1, wherein the steel further contains 0.001-0.06 mass % Al.

3. The process for producing a forged product as claimed in claim 2, wherein the steel contains as another element 0.30 mass % or lower and greater than 0 mass % Bi.

4. The process for producing a forged product as claimed in claim 1, wherein the steel contains 0.02-3.5 mass % of Ni.

5. The process for producing a forged product as claimed in claim 1, wherein a temperature of the portion required to have the fatigue strength is made to reach the temperature range by using excess heat of the hot forging when conducting the forging process.

6. The process for producing a forged product as claimed in claim 1, wherein, after the hot forging, a temperature of the intermediate forged product is lowered to room temperature, and then a temperature of the portion required to have the fatigue strength in the intermediate forged product is increased to the temperature range to conduct the forging process.

7. The process for producing a forged product as claimed in claim 1, wherein the portion required to have the fatigue strength in the intermediate forged product is a flange portion of a crankshaft.

8. The process for producing a forged product as claimed in claim 1, wherein the portion required to have the fatigue strength in the intermediate forged product is a gear shaft portion of a crankshaft.

9. The process for producing a forged product as claimed in claim 1, wherein the portion required to have the fatigue strength in the intermediate forged product is a pin portion of a crankshaft.

10. The process for producing a forged product as claimed in claim 1, wherein the portion required to have the fatigue strength in the intermediate forged product is a journal portion of a crankshaft.

* * * * *